US005836140A

United States Patent [19]

Lancaster, III

[11] Patent Number: 5,836,140

[45] Date of Patent: Nov. 17, 1998

[54] WRAPPING A LOAD WHILE CONTROLLING WRAP TENSION

[75] Inventor: Patrick R. Lancaster, III, Louisville, Ky.

[73] Assignee: Lantech, Inc., Louisville, Ky.

[21] Appl. No.: 746,545

[22] Filed: Nov. 13, 1996

[51] Int. Cl.[6] ..... B65B 13/02

[52] U.S. Cl. ..... 53/399; 53/441; 53/556; 53/389.4; 53/64

[58] Field of Search ..... 53/441, 556, 399, 53/587, 588, 389.4, 389.2, 64

[56] References Cited

U.S. PATENT DOCUMENTS

| | | | |
|---|---|---|---|
| 3,885,678 | 5/1975 | Borg et al. | 214/1 BB |
| 4,132,318 | 1/1979 | Wang et al. | 214/1 BB |
| 4,503,658 | 3/1985 | Mouser et al. | 53/399 |
| 4,514,955 | 5/1985 | Mouser et al. | 53/64 |
| 4,555,050 | 11/1985 | Krieger et al. | 212/211 |
| 4,590,746 | 5/1986 | Humphrey | 53/556 |
| 4,593,517 | 6/1986 | Mattila | 53/441 |
| 4,676,048 | 6/1987 | Lancaster et al. | 53/399 |
| 4,693,049 | 9/1987 | Humphrey | 53/64 |
| 4,712,354 | 12/1987 | Lancaster et al. | 53/399 |
| 4,866,909 | 9/1989 | Lancaster, III et al. | 53/399 |
| 4,934,123 | 6/1990 | Salzsauler | 53/399 |
| 4,938,008 | 7/1990 | Salzsauler | 53/556 |
| 4,993,209 | 2/1991 | Haloila | 53/399 |
| 4,995,224 | 2/1991 | Yourgalite et al. | 53/540 |
| 5,005,335 | 4/1991 | Yourgalite et al. | 53/399 |
| 5,046,303 | 9/1991 | Becicka et al. | 53/540 |
| 5,107,657 | 4/1992 | Diehl et al. | 53/141 |
| 5,163,264 | 11/1992 | Hannen | 53/64 |
| 5,240,139 | 8/1993 | Chirnomas | 221/2 |
| 5,311,725 | 5/1994 | Martin et al. | 53/556 |
| 5,315,809 | 5/1994 | Gordon et al. | 53/399 |
| 5,336,042 | 8/1994 | Winski et al. | 414/789.5 |
| 5,357,733 | 10/1994 | Weikert | 53/64 |
| 5,372,472 | 12/1994 | Winski et al. | 414/786 |
| 5,390,476 | 2/1995 | Morantz | 53/556 |
| 5,404,691 | 4/1995 | Scherer | 53/399 |
| 5,423,163 | 6/1995 | Wendt | 53/556 |
| 5,445,493 | 8/1995 | Yourgalite et al. | 414/791.6 |
| 5,463,842 | 11/1995 | Lancaster | 53/399 |

*Primary Examiner*—Linda Johnson
*Assistant Examiner*—John Paradiso
*Attorney, Agent, or Firm*—Finnegan, Henderson, Farabow, Garrett & Dunner, L.L.P.

[57] ABSTRACT

A stretch wrapping machine includes a film dispenser for dispensing packaging material and tensioning control means for controlling the tension of the packaging material during application to a load. The dispenser and tension controlling means may be used with a round frame, a frame with corners, a driving mechanism or a turntable, at least one of which will have signaling means for activating the tension controlling means.

52 Claims, 13 Drawing Sheets

WRAPPING A LOAD WHILE CONTROLLING WRAP TENSION

BACKGROUND OF THE INVENTION

1. Field of the Invention

The present invention relates to methods and apparatus for wrapping a load with packaging material, and more particularly, stretch wrapping.

2. Related Art

Various packaging techniques have been used to build a load of unit products and subsequently wrap them for transportation, storage, containment and stabilization, protection and waterproofing. One popular system uses stretch wrapping machines to stretch, dispense, and wrap stretch packaging material around a load. Such machines may have various semi-automatic and automatic features depending on their application and cost constraints. For example, the dispenser can include a pre-stretch device or be assisted or powered by a motor connected to the stretching portion.

Stretch wrapping machines provide relative rotation between a stretch wrap packaging dispenser and a load either by driving the stretch wrap packaging dispenser around a stationary load or rotating the load on a turntable. Upon relative rotation, packaging material is wrapped on the load. When stretch wrapping a typical rectangular load, the demand for packaging material varies, decreasing as the packaging material approaches contact with a corner of the load and increasing after contact with the load.

The amount of force, or pull, which the packaging material exhibits on the load determines how tightly and securely the load is wrapped. Conventionally, this force is controlled by controlling the tension or feed rate of the packaging material dispensed by the packaging material dispenser with respect to the demand rate of packaging material required by the load. Efforts have been made to supply the packaging material at a constant tension or at a supply rate that increases as the demand rate increases and decreases as the demand rate decreases. However the results of those efforts have still resulted in fluctuations between the feed and demand rates that have resulted in loose packaging of the load, or have resulted in breaking the packaging material during wrapping.

SUMMARY OF THE INVENTION

Accordingly, the present invention is directed to an improved apparatus and method that obviates such limitations and disadvantages.

Additional features and advantages of the present invention will be set forth in the description which follows, and in part will be apparent from the description, or may be learned by practice of the invention. The objectives and advantages of the invention will be realized and attained by means of the elements and combinations particularly pointed out in the appended claims.

To achieve these and other advantages and in accordance with the present invention, as embodied and broadly described herein, a method and apparatus for wrapping a load is provided.

According to one aspect of the invention, packaging material is automatically wrapped around a load having corners and for which demand for packaging material decreases as the packaging material approaches a corner and increases after the packaging material intercepts a corner. Relative rotation is provided between the load having corners and a packaging material dispenser to wrap the packaging material around the load. The tension on the packaging material is controlled to lock in the highest tension on the packaging material during the relative rotation as each corner intercepts the packaging material.

According to another aspect of the invention, a packaging material dispenser is driven around a frame having corners and for which demand for packaging material decreases as the packaging material dispenser approaches a corner and increases after the packaging material dispenser passes a corner to wrap packaging material around a load. The tension on the packaging material is controlled, locking in the highest tension on the packaging material during the relative rotation as the packaging material dispenser passes a corner of the frame.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

The present invention relates to an apparatus and method for stretch wrapping a load in an efficient manner so as to tightly and securely wrap the load at a desired tension without rupturing the packaging material. According to one aspect of the invention, a packaging material dispenser is driven around a wrapping frame of the stretch wrapping apparatus. As the dispenser travels around the wrapping frame, it dispenses packaging material around the load.

Figure 1:
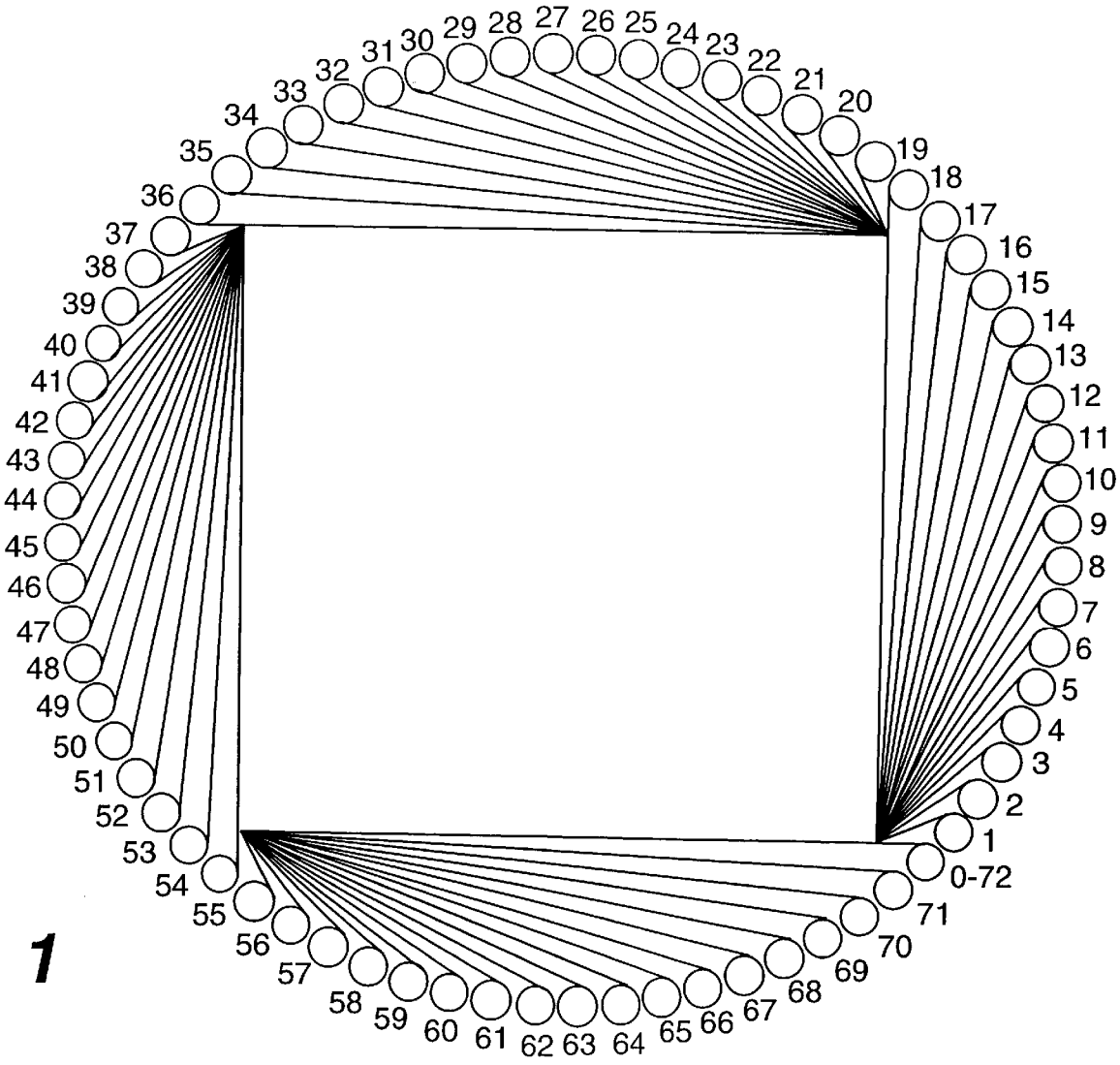
FIG. 1 is a top view of a load within a round wrapping frame.

For purposes of describing the present invention, the wrapping frame may be considered as a series of points, as shown, for example, by points 0–72 in FIG. 1. As the dispenser moves between points, the amount of film necessary to be dispensed in order for the dispenser to reach the next point varies. In other words, the amount of film required for the dispenser to travel from point 1 to point 2 is different from the amount of film required for the dispenser to travel from point 2 to point 3, and so on.

The demand rate is the difference between the amount of packaging material needed to reach point 2 from point 1, divided by the amount of time it takes the dispenser to travel between these points. The feed rate or supply rate, also described earlier, is the actual amount of packaging material dispensed by the dispenser as it travels from point 1 to point 2, divided by the time it takes to travel between these points. As the dispenser travels around the load, the demand rate is constantly changing.

The present invention is directed to a method of compensating for the variation in demand rate so as to apply the wrapping material to a load at a desired force, maintain the desired containment tension on the wrapping material on the load after wrapping, and prevent the wrapping material from rupturing during wrapping. Based on the load to be wrapped and the characteristics of the packaging material, a desired containment force is chosen to be applied to the load. A predetermined feed rate may be calculated based on factors such as the speed of the wrapping ring, the size of load to be wrapped, and the rotational speed of the load. The amount of packaging material needed to be supplied to achieve the desired containment force is then calculated from the predetermined feed rate. The containment force is locked in as the film contacts the corners of the load, which can be traditional corners or other portions projecting from the surface of the load.

The desired containment force is achieved and locked in at each corner and the packaging material is prevented from rupturing by controlling the tension or supply rate of the packaging material so that the tension is increased as the packaging material approaches and contacts the next projecting circumferential portion or corner. The tension is decreased and the supply rate is increased after the packaging material intercepts an extending circumferential portion or corner of the load to be wrapped. The tension is decreased sufficiently to avoid film rupture after the intercept occurs. Therefore, the tension and or supply of the film is controlled to be substantially the highest in the cycle just prior to the intercept of the next projecting circumferential portion or corner by the packaging material. After each intercepted point, the tension again builds as a new projecting circumferential portion or corner is approached. A sudden force or force spike may be applied to the packaging material just as the corner or projecting circumferential portion is intercepted or the force may be applied more gradually during the approach. In either case, the force is locked in as it is applied to the projecting circumferential portion or corner. The tension may be controlled in a variety of ways including using a controller, such as a microprocessor or an electromechanical control system to control brakes, motors, clutches or accumulators for the packaging material by the packaging material dispenser. Signaling or sensing mechanisms such as photocells or mechanism switches may be used to signal the controller to direct film tensioning or film supply changes.

Figure 5:
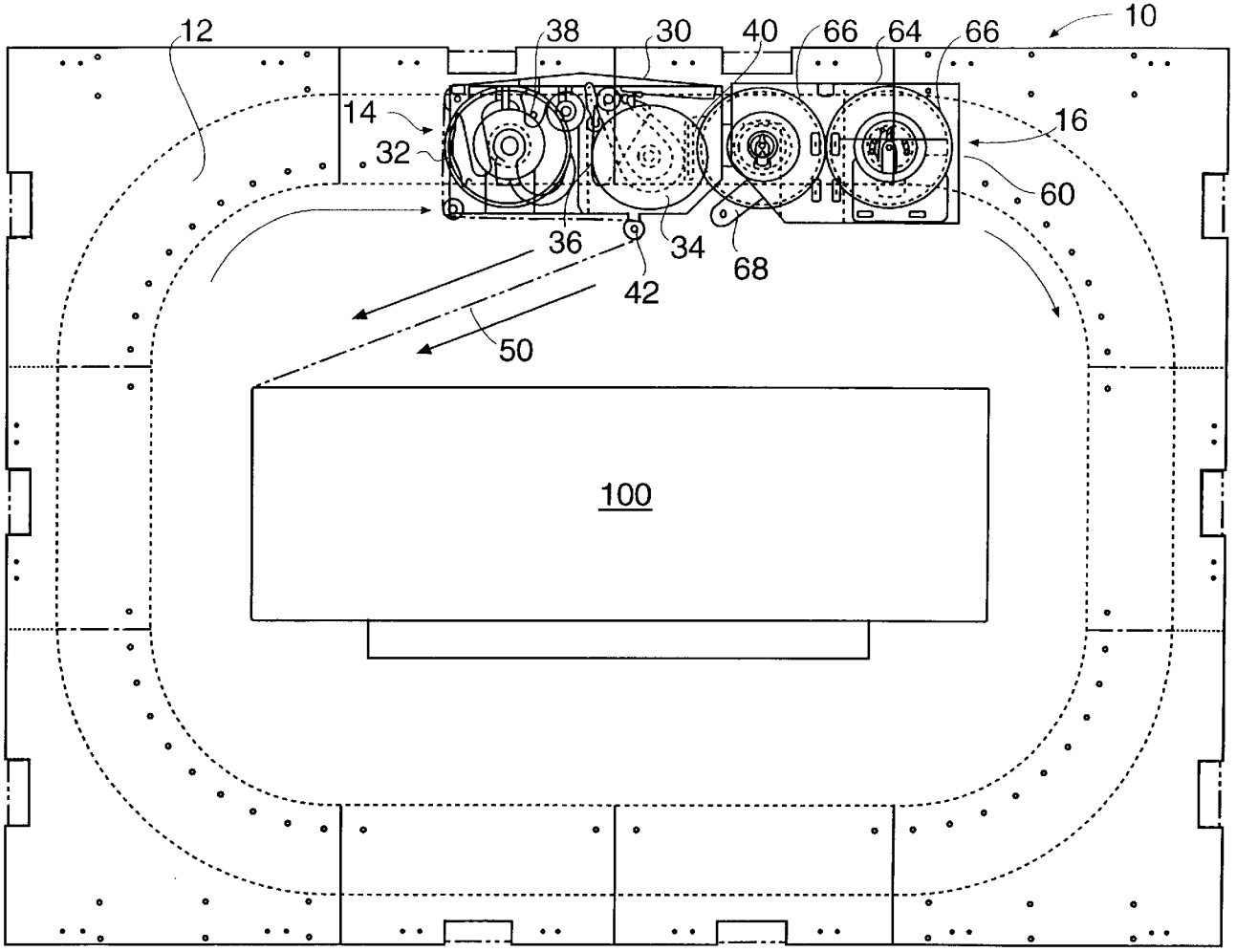
FIG. 5 is a schematic sectional view of another embodiment of a wrapping apparatus of the present invention.

FIG. 5 shows a stretch wrapping apparatus 10 for stretch wrapping a load and using controlling film tension according to the present invention. Stretch wrapping apparatus 10 includes wrapping frame 12, a film dispenser 14, a drive mechanism 16 such as a motor drive, and tensioning controller for wrapping load 100.

Figure 3:
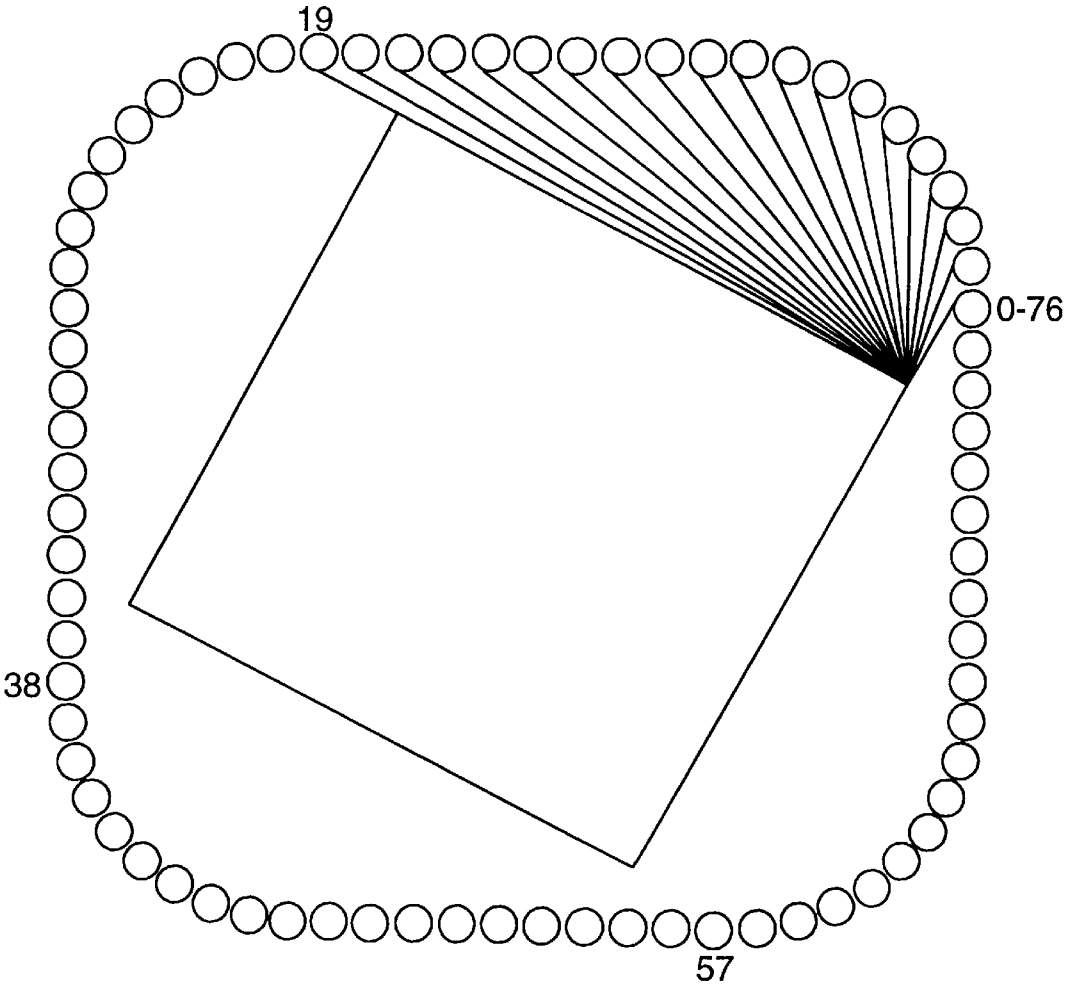
FIG. 3 is a top view of a load within a non-round wrapping frame.
Figure 7:
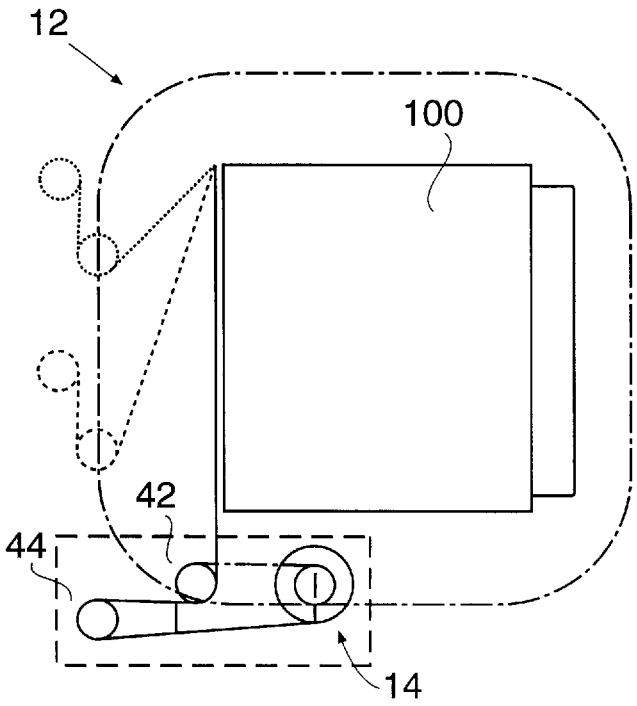
FIG. 7 is a top view of a still another embodiment of a wrapping apparatus of the present invention.

Wrapping frame 12 may be of any desired shape. For example, frame 12 may be circular as depicted in FIG. 1, or may have rounded corners and straight segments, as shown in FIGS. 3, 5, and 7. Wrapping frame 12 can include one or more sensors which react to pressure, blockage of light, interruption of signal, or other stimuli from film dispenser 14 or drive mechanism 16 to signal and directly or indirectly activates the tension controlling means. The sensors may be, for example, photocells, pressure sensitive points, actuator switches, limit switch, or proximity switches. The sensors are preferably located at predetermined points of wrapping frame 12. When rotating film dispenser 14 or drive mechanism 16 activates the sensor means at these points, the tension controlling means is activated.

As an alternative, and especially in stretch wrapping apparatuses that utilize a stationary dispenser and a load rotating on a turntable, signaling devices may be provided at corners or other predetermined points of wrapping frame 12 which "flag" a signaling device used on a rotating turntable. For example, four flags may be provided, one at each corner of wrapping frame 12, to signal a stop or change in speed of the turntable or signal a stop or change in speed in the dispensing of film. The length of the stop or change in speed is then controlled by a timer. Alternatively, two flags may be provided for each stop or change in speed, one to signal a start and one to signal a stop.

A film dispenser 14, for use in the stretch wrapping apparatus of the present invention, is shown in FIG. 5 as film car 30. Film car 30 includes wheels 32 for traveling on wrapping frame 12. As an alternative to wheels 32, film car 30 may use casters, ball bearings, or grooves to travel along wrapping frame 12. As a further alternative, film car 30 may be stationary, and the load rotate.

Film car 30 further includes a roll of film 34 therein, prestretch rollers 36, 38 connected to and driven by a motor 40, and film positioning roller 42. Film dispenser 14 may also contain tensioning control means for controlling the tension of the stretch packaging material. The tensioning control means may be signal activated. As shown in FIG. 7, the tensioning control means comprises a kick out roller 44. Kick out roller 44 is attached to the film dispenser frame at the rear of film dispenser 14 and acts as a film pivot extended away from film dispenser 14. Kick out roller 44 travels away from the load corner at precisely the time needed to pull the film tight and increase tension before passing the next load corner. Kick out roller 44 performs as a natural part of the film path geometry by being an off axle extension of film dispenser 14.

Film dispenser 14 further includes a braking mechanism on film roll 34 to prevent or slow dispensing of film packaging material 50. For example, a clutch mechanism between motor 40 and prestretch roller 36 may be used for disconnecting prestretch roller 36 from motor 40 to stop feeding of film 50 from roll 34. Such a mechanism will be described later in connection with FIG. 2. Other signal activated means may be used to stop or considerably slow dispensing of film packaging material 50.

Figure 6:
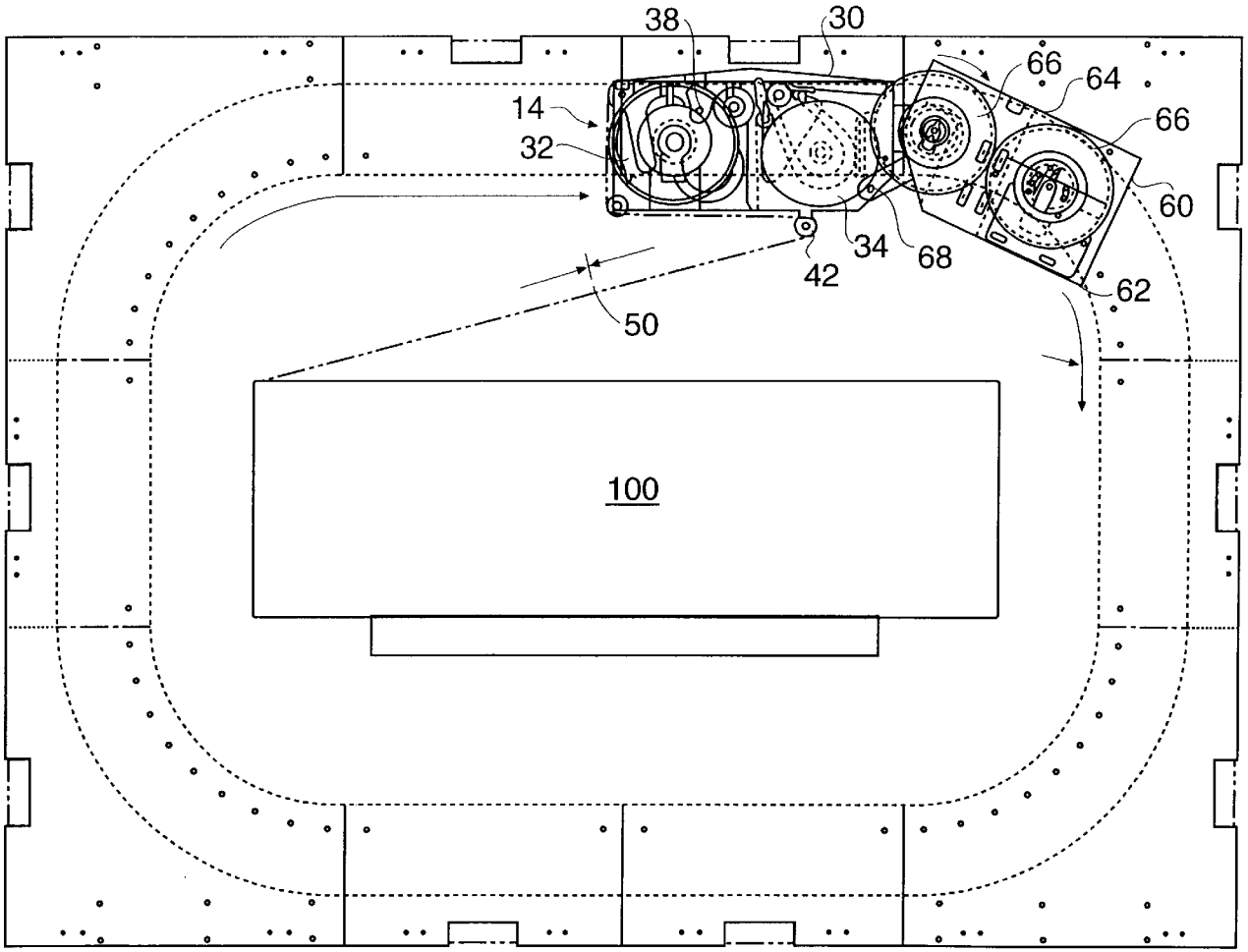
FIG. 6 is a schematic sectional view of the embodiment of FIG. 5 at a later point in time.

As shown in FIGS. 5 and 6, the drive mechanism 16 for driving the film dispenser 14 includes a motor car 60 that includes a signaling or sensing mechanism, a motor 62, a body 64, and wheels 66 for traveling on wrapping frame 12. As with film car 30, motor car 60 may use casters, ball bearings, or grooves, instead of wheels 66, to travel along wrapping frame 12. Motor car 60 preferably includes a signaling switch 68 for activating the tensioning control means. Signaling switch 68 is preferably a proximity switch which contacts film car 30 when there is a change in relative positions between film car 30 and motor car 60. As shown in FIG. 6, this change in relative position indicates that cars 30 and 60 are reaching a corner of wrapping frame 12. Contact between signaling switch 68 and film car 30 activates the tensioning control means.

As shown in FIGS. 5 and 6, a load 100 to be wrapped is centered within wrapping frame 12. Film car 30 is connected to motor car 60 so that motor car 60 drives film car 30 around frame 12. Film 50 is dispensed from film car 30 at film positioning roller 42 as film car 30 travels around wrapping frame 12. As shown in FIG. 6, as motor car 60 approaches a corner of wrapping frame 12, proximity switch 68 contacts film car 30 to send a signal indicating that a corner is approaching, and that the film tensioning control means should be activated. Once activated, the film tensioning control means remains activated until film 50 intercepts and locks onto a corner of load 100. The film tensioning control means can include a brake or other mechanism to stop feeding film 50, an accumulator which collects the film being fed and prevents dispensing of film 50, or a means of instantaneous acceleration for changing the speed of dispenser 14 or a turntable and which runs on a timer. Other signaling means such as photocells or mechanical switches may be located within the track, or on a turntable under corners of the load.

Tensioning control means may also be used in a stretch wrapping apparatus that uses a stationary film dispenser and a rotatable turntable that carries the load. The turntable may include sensing or signaling means for determining when a corner of the wrapping frame is being approached. Activation of the signaling means also activates the tensioning control means.

According to an aspect of the present invention, the tensioning control means may be an accumulator which does not stop or slow release of film packaging material 50 from roll of film 34, but does prevent dispensing of film packaging material for a period of time which may be determined by signaling or a timer. Such an accumulator, for example, may be a powered dancer bar, rotatable rollers or kick out arm which is actuated just prior to an intersection of the film and a corner of the load. Alternatively, a motor within either film dispenser 14 or drive mechanism 16 may be instantaneously accelerated just prior to an intersection of the film and a corner of the load in order to rapidly increase or "spike" the wrap force just before the force is locked in at the corner. The tensioning control means may be controlled, for example, by a microprocessor, an electromechanical mechanism or a timing switch.

FIGS. 8 and 9A–9D show another embodiment of a stretch wrapping apparatus according to an aspect of the present invention. In this embodiment, the tension of the stretch packaging material is affected by a turntable 120 and a moveable film dispenser 114. Turntable 120 rotates and supports a load 100A to be wrapped. Film dispenser 114 is attached to a column 150 and includes a roll of film 134 and prestretch rollers 136 and 138. Dispenser 114 can be moved vertically on column 150 and horizontally by piston 142.

Figure 9A:
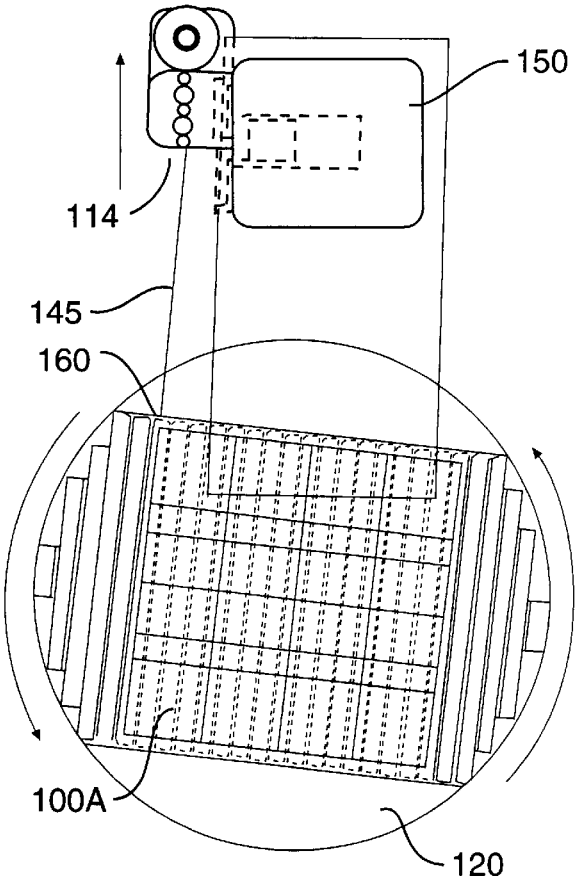
FIGS. 9A–9D are top views of the apparatus of FIG. 8 at various positions during use.
Figure 9B:
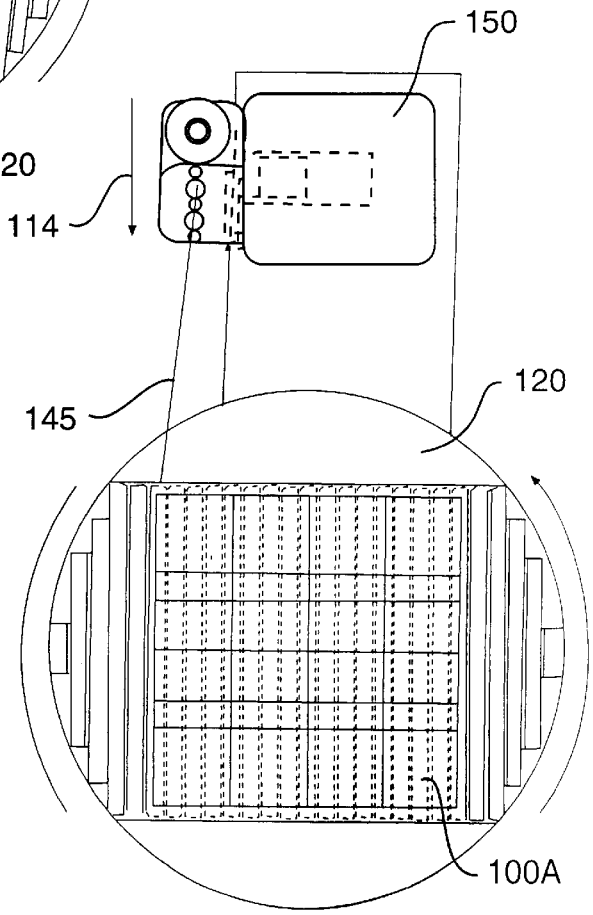
Figure 9C:
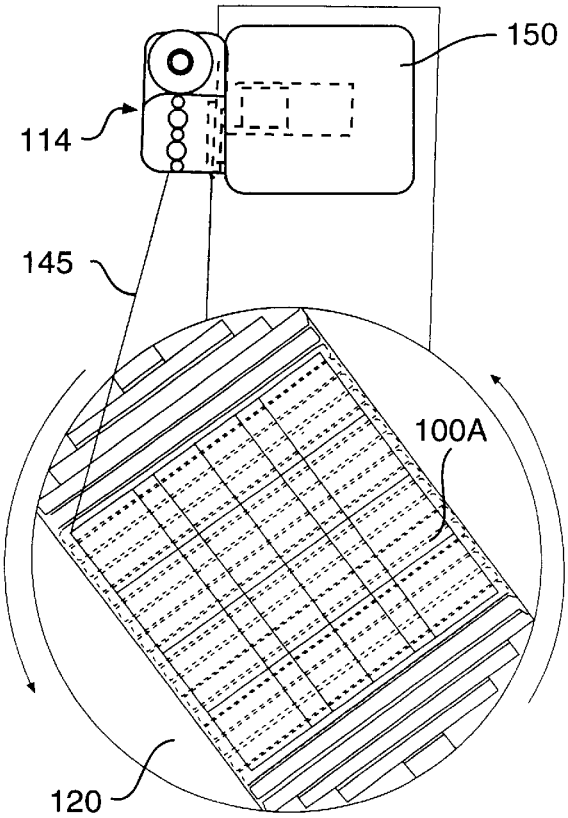
Figure 9D:
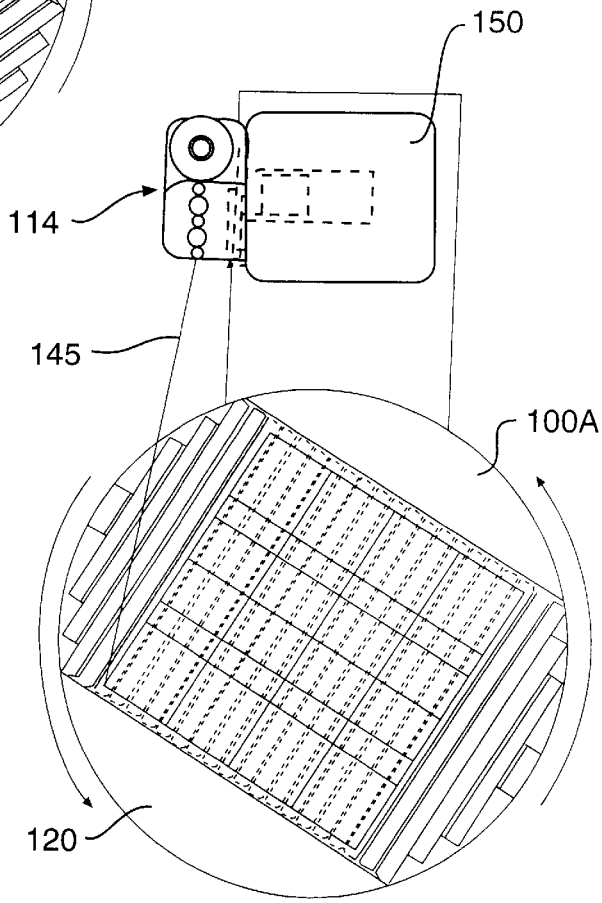

FIGS. 9A–9D show various stages of the rotation of load 100A on turntable 120. As shown in FIG. 9A, just prior to an intersection of film 145 and a corner 160 of load 100A, film dispenser 114 moves horizontally away from load 100A and turntable 120. This increases the tension of film 145 as film 145 intersects corner 160. Film dispenser 114 then returns to its original horizontal position, as shown in FIG. 9B, and remains there while load 100A rotates on turntable 120, and until the next point of corner intersection between film 145 and load 100A is approached. The process then repeats.

FIGS. 10–21 schematically illustrate a general example of wrapping a load 200 according to an aspect of the present invention. Load 200 is positioned on turntable 230 and includes four sides 270, 272, 274, 276, and a center of rotation 210. These figures illustrate the wrapping of one side 276. The steps shown are successively repeated for each side until load 200 is completely wrapped. To wrap load 200, film is dispensed from an exit roller 200 of a film dispenser onto load 200. As load 200 rotates, the length of the film between exit roller 220 and a contact point on load 200 changes, as illustrated by the varying lengths of film 234, 236, 238, 240, 242, 244, 246, 248, 250, and 252 shown in FIGS. 10–21.

Figure 10:
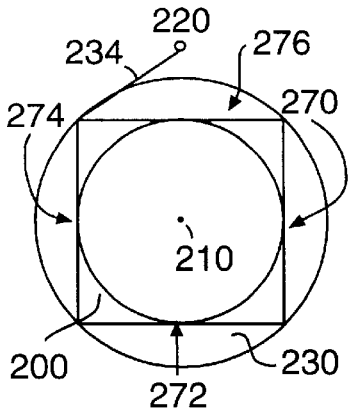
FIGS. 10–21 are top views of a load being wrapped according to an aspect of the present invention.
Figure 11:
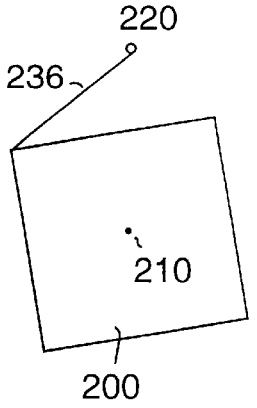
Figure 12:
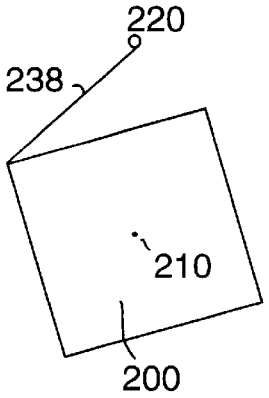
Figure 13:
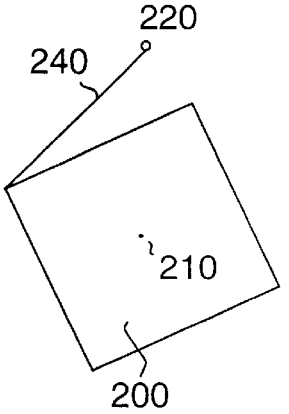
Figure 14:
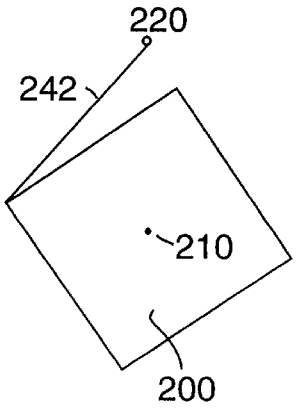
Figure 15:
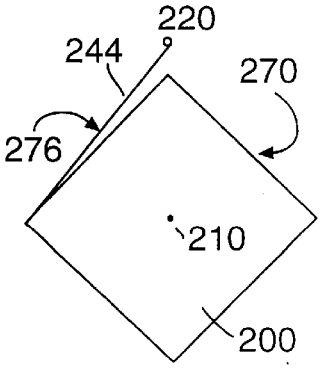
Figure 16:
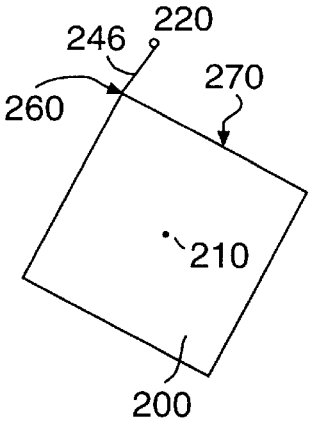
Figure 17:
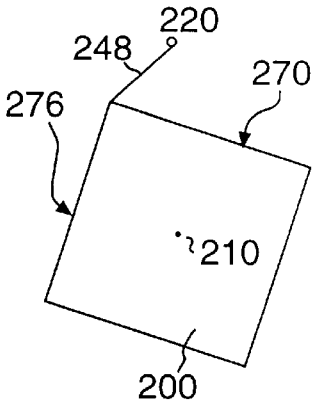
Figure 18:
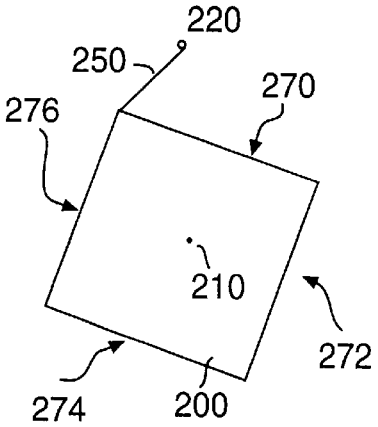
Figure 19:
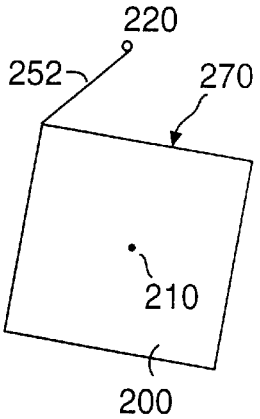
Figure 20:
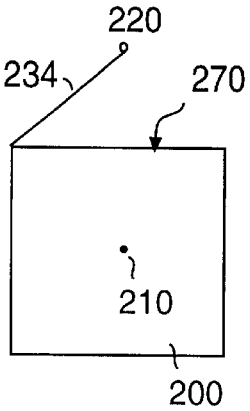
Figure 21:
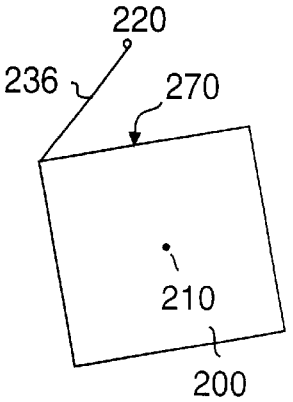
Figure 22:
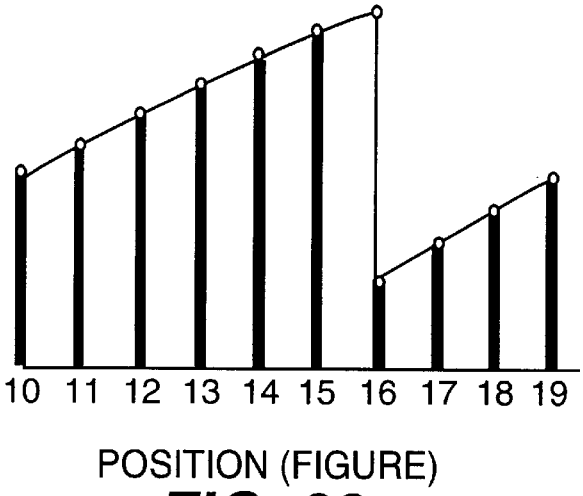
FIG. 22 is a graph of the film length at the various positions shown in FIGS. 10–21.
Figure 23:
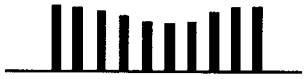
FIG. 23 is a graph of the difference between film lengths for each progressive load position shown in FIGS. 10–21.
Figure 24:
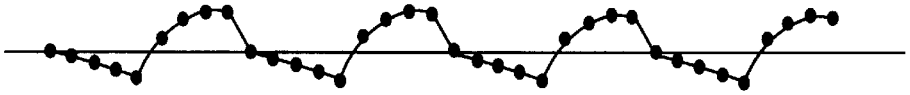
FIG. 24 is a graph of the difference between the differences of FIG. 23 for each progressive load position shown in FIGS. 10–21.

FIG. 22 is a graph of film length at progressive load positions, beginning with the position in FIG. 10 and ending with the position in FIG. 19. FIG. 23 is a graph of the difference between film lengths for each progressive load position, and FIG. 24 is a graph of the difference of differences at each rotational position. Points above the line indicate a positive difference and points below the line indicating a negative difference. Note that the lowest point is where the film intercepts a corner or other portion of the load and is also the point where the force of the film is locked in during wrapping.

As a supplement to the tensioning control means, a measuring roller may be used to rotate around the wrapping frame opposite the film dispenser. The measuring roller contacts a surface of the load being wrapped to indicate when corners of the load are approaching. The measuring roller would then activate the film tensioning means.

Figure 2:
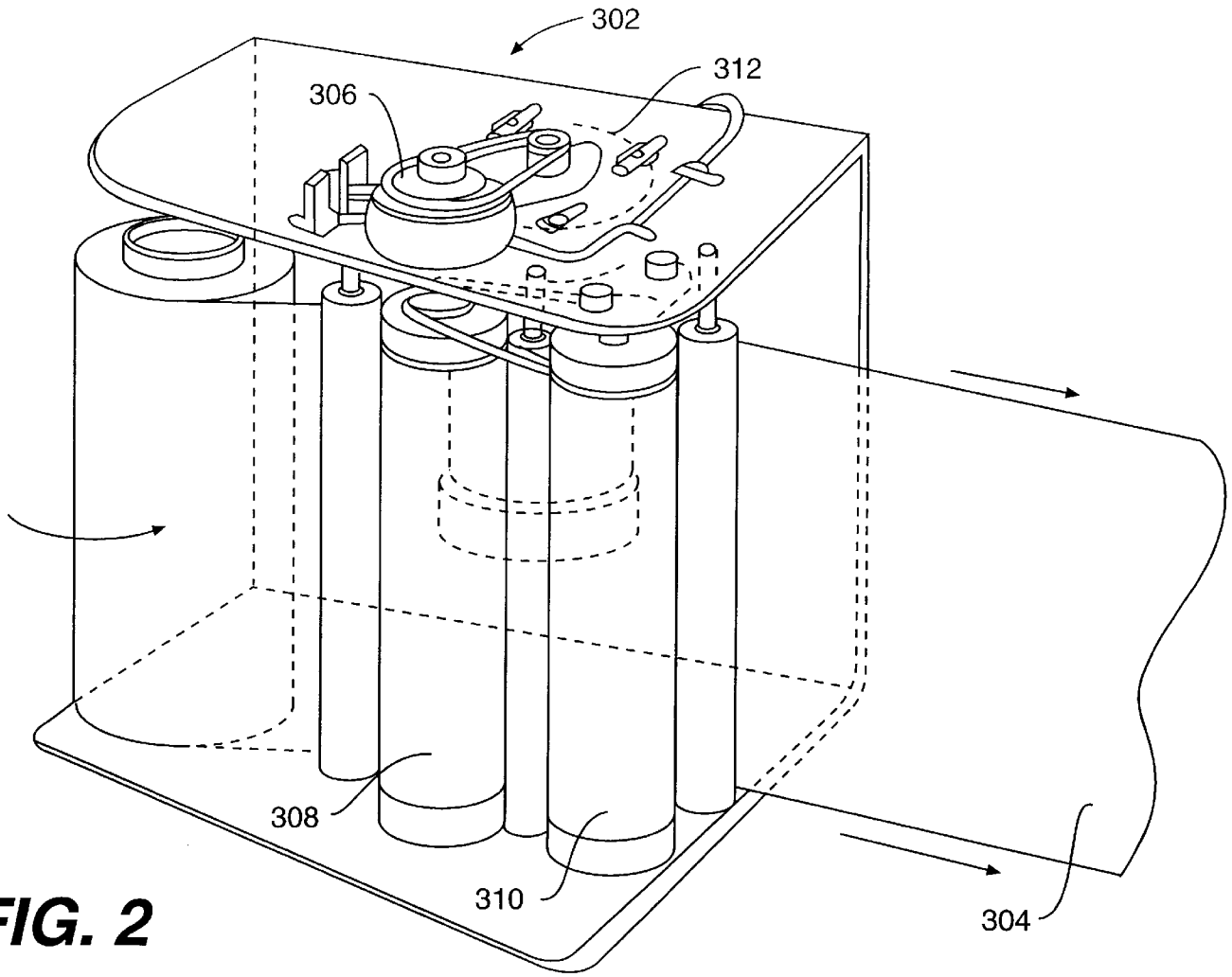
FIG. 2 is a perspective view of an embodiment of a film dispenser for use in a stretch wrapping apparatus according to an aspect of the present invention.

FIG. 2 shows another embodiment of a film dispenser for use in a stretch wrapping apparatus according to an aspect of the present invention. Film dispenser 302 includes a clutch mechanism 306 that is connected to the shaft of a first prestretch roller 308. First prestretch roller 308 is connected to a second prestretch roller 310. When clutch 306 is engaged, a drive motor 312 transmits power to first roller 308 to turn rollers 308, 310 to help push film 304 out of dispenser 302. When film 304 is about to intercept a corner of a load, clutch 306 disengages so that first and second rollers 308, 310 do not help to force film 304 out of film dispenser 302. At that point, only the rotation of the load pulls film 304 out of film dispenser 302. This causes the tension in film 304 to significantly increase as it approaches and contacts the corners to tightly wrap the load at its corners.

Figure 4A:
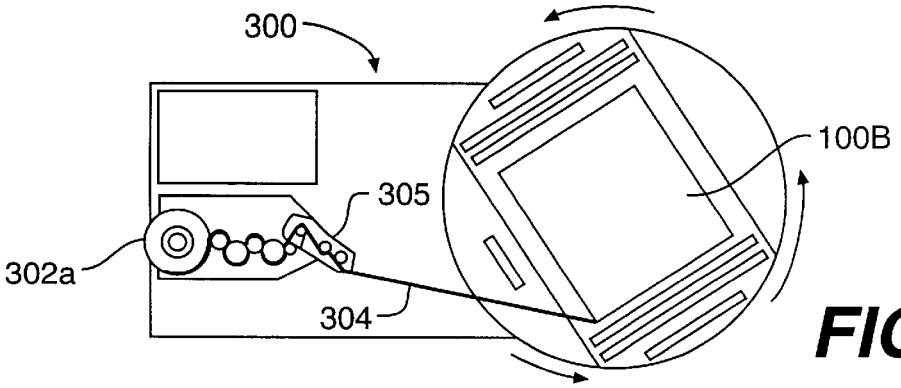
FIGS. 4A–4C are top views of an embodiment of a stretch wrapping apparatus, according to an aspect of the present invention, at various positions during use.
Figure 4B:
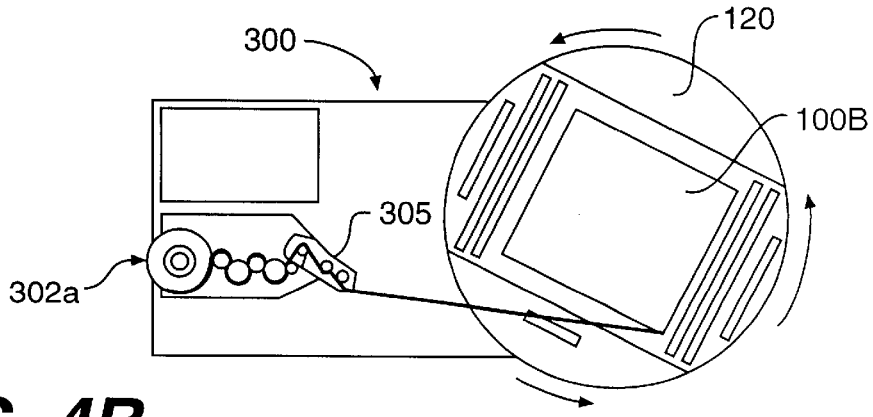
Figure 4C:
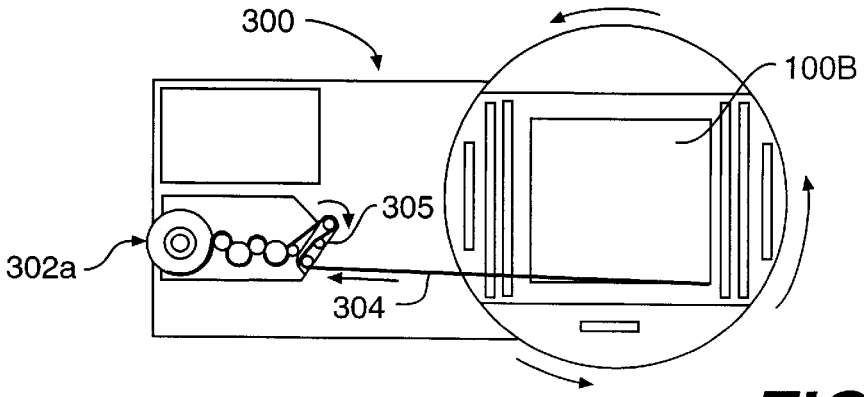
Figure 8:
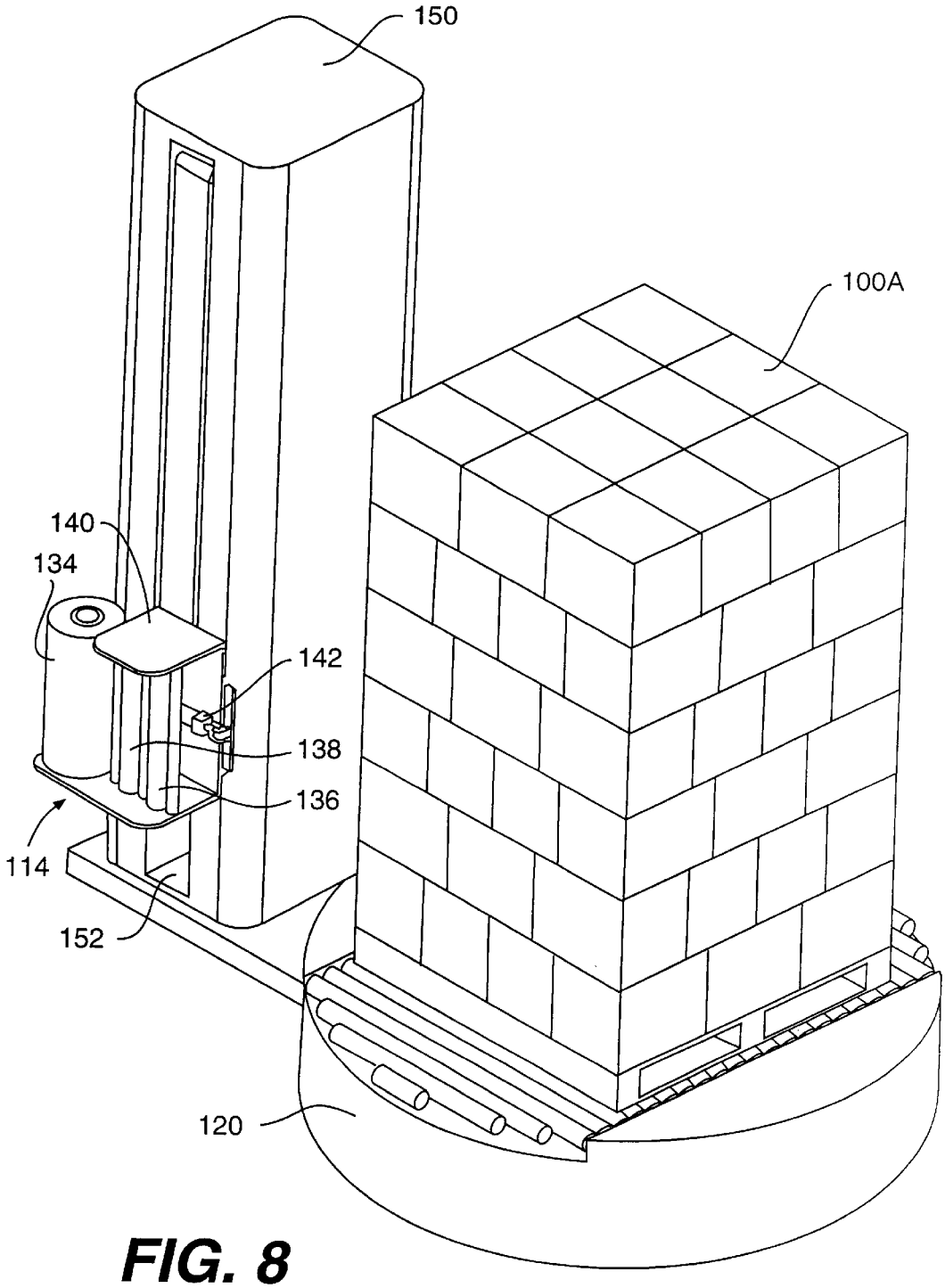
FIG. 8 is an isometric view of a yet another embodiment of a wrapping apparatus of the present invention.

As shown in FIGS. 4A–4C, a load 100B is rotating on a turntable 120 of a stretch wrapping apparatus 300, similar to that shown and described in connection with FIG. 8. Film dispenser 302*a* includes an accumulator 305 that accumulates film 304 into film dispenser 302*a* just prior to film 304 intercepting a corner of load 100B. A portion of film 304 is pulled back into film dispenser 302*a*, when accumulator 305 rotates to the position shown in FIG. 4C, thereby decreasing the supply of film to the load and increasing the tension on the film as the film approaches and contacts each corner of load 100B. The accumulator subsequently rotates to release the accumulated film as the corner passes.

Other embodiments of the invention will be apparent to those skilled in the art from considering the specification and practicing the invention disclosed herein. Other wrapping materials may be used. It is intended that the specification and examples be considered as exemplary only, with true scope and spirit of the invention being indicated by the following claims and their equivalents.

I claim:

1. A method for automatically wrapping packaging material around a load having corners and for which demand for packaging material decreases as the packaging material approaches contact with a corner and increases after the packaging material intercepts a corner comprising:

providing relative rotation between a load having corners and a packaging material dispenser to wrap the packaging material around the load;

automatically varying the tension on the packaging material around the time the packaging material intercepts a corner of the load to apply substantially the highest tension during wrapping to the packaging material near each corner of the load, locking in substantially the highest tension on the packaging material during wrapping as each corner intercepts the packaging material.

2. The method of claim 1 including increasing the tension on the packaging material as the packaging material approaches contact with a corner of the load.

3. The method of claim 1 including decreasing the tension on the packaging material after the packaging material intercepts a corner of the load.

4. The method of claim 2 including decreasing the tension on the packaging material after the packaging material intercepts a corner of the load.

5. The method of claim 1 including decreasing the supply of the packaging material as the packaging material approaches a corner of the load faster than the decrease in demand for packaging material as the packaging material approaches that corner of the load.

6. The method of claim 1 including increasing the supply of the packaging material after the packaging material intercepts a corner of the load faster than the increase in demand for packaging material as the packaging material approaches that corner of the load.

7. The method of claim 5 including increasing the supply of the packaging material after the packaging material intercepts a corner of the load faster than the increase in demand for packaging material as the packaging material approaches that corner of the load.

8. The method of claim 1 wherein the step of controlling the tension includes engaging a brake in the packaging material dispenser as the packaging material approaches a corner of the load.

9. The method of claim 1 wherein the step of controlling the tension includes accumulating packaging material in the packaging material dispenser as the packaging material approaches a corner of the load.

10. The method of claim 1 wherein the step of controlling the tension includes disengaging a clutch in the packaging material dispenser after the packaging material intercepts a corner of the load.

11. The method of claim 1 wherein the step of controlling the tension includes releasing accumulated packaging material in the packaging material dispenser after the packaging material intercepts a corner of the load.

12. The method of claim 1 including sensing the position of the packaging material dispenser relative to the load and wherein the controlling step is performed responsive to the position of the packaging material dispenser relative to the load.

13. The method of claim 1 including sensing the tension in the packaging material and wherein the controlling step is performed responsive to sensing the tension.

14. A method for automatically wrapping packaging material around a load comprising:

driving a packaging material dispenser around a frame having corners and for which demand for packaging material decreases as the packaging material dispenser approaches a corner and increases after the packaging material dispenser passes a corner to wrap packaging material around a load;

automatically varying the tension on the packaging material around the time the packaging material intercepts a corner of the frame to apply substantially the highest tension during wrapping to the packaging material near each corner of the frame, locking in substantially the highest tension on the packaging material during wrapping as the packaging material dispenser passes a corner of the frame.

15. The method of claim 14 including increasing the tension on the packaging material as the packaging material approaches a corner of the frame.

16. The method of claim 14 including decreasing the tension on the packaging material after the packaging material passes a corner of the frame.

17. The method of claim 15 including decreasing the tension on the packaging material after the packaging material passes a corner of the frame.

18. The method of claim 14 including decreasing the supply of the packaging material as the packaging material approaches a corner of the frame faster than the decrease in demand for packaging material as the packaging material approaches that corner of the frame.

19. The method of claim 14 including increasing the supply of the packaging material after the packaging material passes a corner of the frame faster than the increase in demand for packaging material after the packaging material passes that corner of the frame.

20. The method of claim 18 including increasing the supply of the packaging material after the packaging material passes a corner of the frame faster than the increase in demand for packaging material after the packaging material passes that corner of the frame.

21. The method of claim 14 controlling step includes engaging a brake in the packaging material dispenser as the packaging material approaches a corner of the frame.

22. The method of claim 14 wherein the step of controlling the tension includes accumulating packaging material on the packaging material dispenser as the packaging material approaches a corner of the frame.

23. The method of claim 14 wherein the step of controlling the tension includes disengaging a clutch in the packaging material dispenser after the packaging material passes a corner of the frame.

24. The method of claim 14 wherein the step of controlling the tension includes releasing accumulated packaging material in the packaging material dispenser after the packaging material passes a corner of the frame.

25. The method of claim 14 including sensing the position of the packaging material dispenser relative to the frame and wherein the controlling step is performed responsive to the position of the packaging material dispenser relative to the frame.

26. The method of claim 14 including sensing the tension in the packaging material and wherein the controlling step is performed responsive to sensing the tension.

27. An apparatus for automatically wrapping packaging material around a load having corners and for which demand for packaging material decreases as the packaging material approaches contact with a corner and increases after the packaging material intercepts a corner comprising:

means for providing relative rotation between a load having corners and a packaging material dispenser to wrap the packaging material around the load;

means for automatically varying the tension on the packaging material around the time the packaging material intercepts a corner of the load to apply substantially the highest tension during wrapping to the packaging material near each corner of the load, locking in substantially the highest tension on the packaging material during wrapping as each corner intercepts the packaging material.

28. The apparatus of claim 27 wherein the controlling means increases the tension on the packaging material as the packaging material approaches contact with a corner of the load.

29. The apparatus of claim 27 wherein the controlling means decreases the tension on the packaging material after the packaging material intercepts a corner of the load.

30. The apparatus of claim 28 wherein the controlling means decreases the tension on the packaging material after the packaging material intercepts a corner of the load.

31. The apparatus of claim 27 wherein the controlling means decreases the supply of the packaging material as the packaging material approaches a corner of the load faster than the decrease in demand for packaging material as the packaging material approaches that corner of the load.

32. The apparatus of claim 27 wherein the controlling means increases the supply of the packaging material after the packaging material intercepts a corner of the load faster than the increase in demand for packaging material as the packaging material approaches that corner of the load.

33. The apparatus of claim 31 wherein the controlling means increases the supply of the packaging material after the packaging material intercepts a corner of the load faster than the increase in demand for packaging material as the packaging material approaches that corner of the load.

34. The apparatus of claim 27 including a packaging material brake and wherein the controlling means engages the packaging material brake as the packaging material approaches a corner of the load.

35. The apparatus of claim 27 including an accumulator, wherein the controlling means actuates the accumulator to accumulate packaging material in the packaging material dispenser as the packaging material approaches a corner of the load.

36. The apparatus of claim 27 including a clutch, wherein the controlling means disengages the clutch after the packaging material intercepts a corner of the load.

37. The apparatus of claim 27 including an accumulator, wherein the controlling means releases accumulated packaging material in the accumulator after the packaging material intercepts a corner of the load.

38. The apparatus of claim 27 including a sensor for sensing the position of the packaging material dispenser relative to the load and wherein the controlling means controls the tension responsive to the sensed position of the packaging material dispenser relative to the load.

39. The apparatus of claim 27 including a sensor for sensing the tension in the packaging material and wherein the controlling means controls the tension responsive to the sensed tension.

40. An apparatus for automatically wrapping packaging material around a load comprising:

means for driving a packaging material dispenser around a frame having corners and for which demand for packaging material decreases as the packaging material dispenser approaches a corner and increases after the packaging material dispenser passes a corner to wrap packaging material around a load; and means for automatically varying the tension on the packaging material around the time the packaging material intercepts a corner of the frame to apply substantially the highest tension during wrapping to the packaging material near each corner of the frame, locking in substantially the highest tension on the packaging material during wrapping as the packaging material dispenser passes a corner of the frame.

41. The apparatus of claim 40 wherein the controlling means increases the tension on the packaging material as the packaging material approaches a corner of the frame.

42. The apparatus of claim 40 wherein the controlling means decreases the tension on the packaging material after the packaging material passes a corner of the frame.

43. The apparatus of claim 41 wherein the controlling means decreases the tension on the packaging material after the packaging material passes a corner of the frame.

44. The apparatus of claim 40 wherein the controlling means decreases the supply of the packaging material as the packaging material approaches a corner of the frame faster than the decrease in demand for packaging material as the packaging material approaches that corner of the frame.

45. The apparatus of claim 40 wherein the controlling means increases the supply of the packaging material after the packaging material passes a corner of the frame faster than the increase in demand for packaging material after the packaging material passes that corner of the frame.

46. The apparatus of claim 44 wherein the controlling means increases the supply of the packaging material after the packaging material passes a corner of the frame faster than the increase in demand for packaging material after the packaging material passes that corner of the frame.

47. The apparatus of claim 40 including a packaging material brake and wherein the controlling means engage the packaging material brake as the packaging material approaches a corner of the frame.

48. The apparatus of claim 40 including an accumulator, wherein the controlling means activates the accumulator to accumulate packaging material in the packaging material dispenser as the packaging material approaches a corner of the frame.

49. The apparatus of claim 40 including a clutch, wherein the controlling means disengages the clutch after the packaging material intercepts a corner of the frame.

50. The apparatus of claim 40 including an accumulator, wherein the controlling means releases accumulated packaging material in the accumulator after the packaging material intercepts a corner of the frame.

51. The apparatus of claim 40 including a sensor for sensing the position of the packaging material dispenser relative to the frame and wherein the controlling means controls the tension responsive to the sensed position of the packaging material dispenser relative to the frame.

52. The apparatus of claim 40 including a sensor for sensing the tension in the packaging material and wherein the controlling means controls the tension responsive to the sensed tension.

* * * * *